US010714280B1

(12) United States Patent
Mohammad

(10) Patent No.: US 10,714,280 B1
(45) Date of Patent: Jul. 14, 2020

(54) MECHANICAL KEYBOARD WITH MODULAR REMOVABLE SWITCHES SUPPORT

(71) Applicant: Shazim Mohammad, Fairview, TX (US)

(72) Inventor: Shazim Mohammad, Fairview, TX (US)

( * ) Notice: Subject to any disclaimer, the term of this patent is extended or adjusted under 35 U.S.C. 154(b) by 0 days.

(21) Appl. No.: 15/462,672

(22) Filed: Mar. 17, 2017

Related U.S. Application Data

(60) Provisional application No. 62/309,608, filed on Mar. 17, 2016.

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/705*** | (2006.01) |
| ***H01H 13/88*** | (2006.01) |

(52) U.S. Cl.
CPC ..... *H01H 13/705* (2013.01); *H01H 13/88* (2013.01)

(58) Field of Classification Search
CPC .. H01H 1/12; H01H 1/14; H01H 1/36; H01H 1/42; H01H 3/00; H01H 3/02; H01H 3/12; H01H 9/02; H01H 9/04; H01H 9/20; H01H 9/24; H01H 9/28; H01H 13/00; H01H 13/02; H01H 13/14; H01H 13/20; H01H 13/26; H01H 13/50; H01H 13/52; H01H 13/68; H01H 13/70; H01H 1003/00; H01H 1003/12; H01H 2009/02; H01H 2009/20; H01H 2013/50; H01H 2013/52; H01H 2215/00; H01H 2215/004
USPC ..... 200/5 A, 43.04
See application file for complete search history.

(56) References Cited

U.S. PATENT DOCUMENTS 6,759,613 B2 * 7/2004 Kurihara ..... H01H 13/70 200/314
2013/0140165 A1 * 6/2013 Lin ..... G06F 3/0202 200/5 A

* cited by examiner

*Primary Examiner* — Anthony R. Jimenez
(74) *Attorney, Agent, or Firm* — Richard G. Eldredge; Eldredge Law Firm

(57) ABSTRACT

A mechanical keyboard includes printed circuit boards (PCBs), each having a pin holder; and a hole; mechanical switches to removably engage with the printed circuit boards, each of the mechanical switches having a body; a pin extending from the body to engage with the pin holder; a pillar extending from the body to engage with the hole; and a compressible switch extending upward from the body and associated with the pillar; a plurality of keys to engage with the compressible switch of the mechanical switches; the plurality of mechanical switches are to be removed from the PCBs by hand.

4 Claims, 4 Drawing Sheets

MECHANICAL KEYBOARD WITH MODULAR REMOVABLE SWITCHES SUPPORT

BACKGROUND

1. Field of the Invention

The present invention relates generally to keyboards, and more specifically, to mechanical keyboards with removable switches support.

2. Description of Related Art

Mechanical keyboards are well known in the art and are effective means for user interaction with a computer. For example, FIG. 1 illustrates a top view of a keyboard 101 with a plurality of keys engaged with a plurality of switches 103 associated with a keyboard PCB 105.

One of the problems commonly associated with keyboard 101 is that the keys and/or switches are soldered in to every PCB of the mechanical keyboard. Accordingly, if a new switch is to be installed or to replace a broken switch, the user is required to purchase a new keyboard unless she/he has the technical skills to unsolder and resolder in a new switch.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
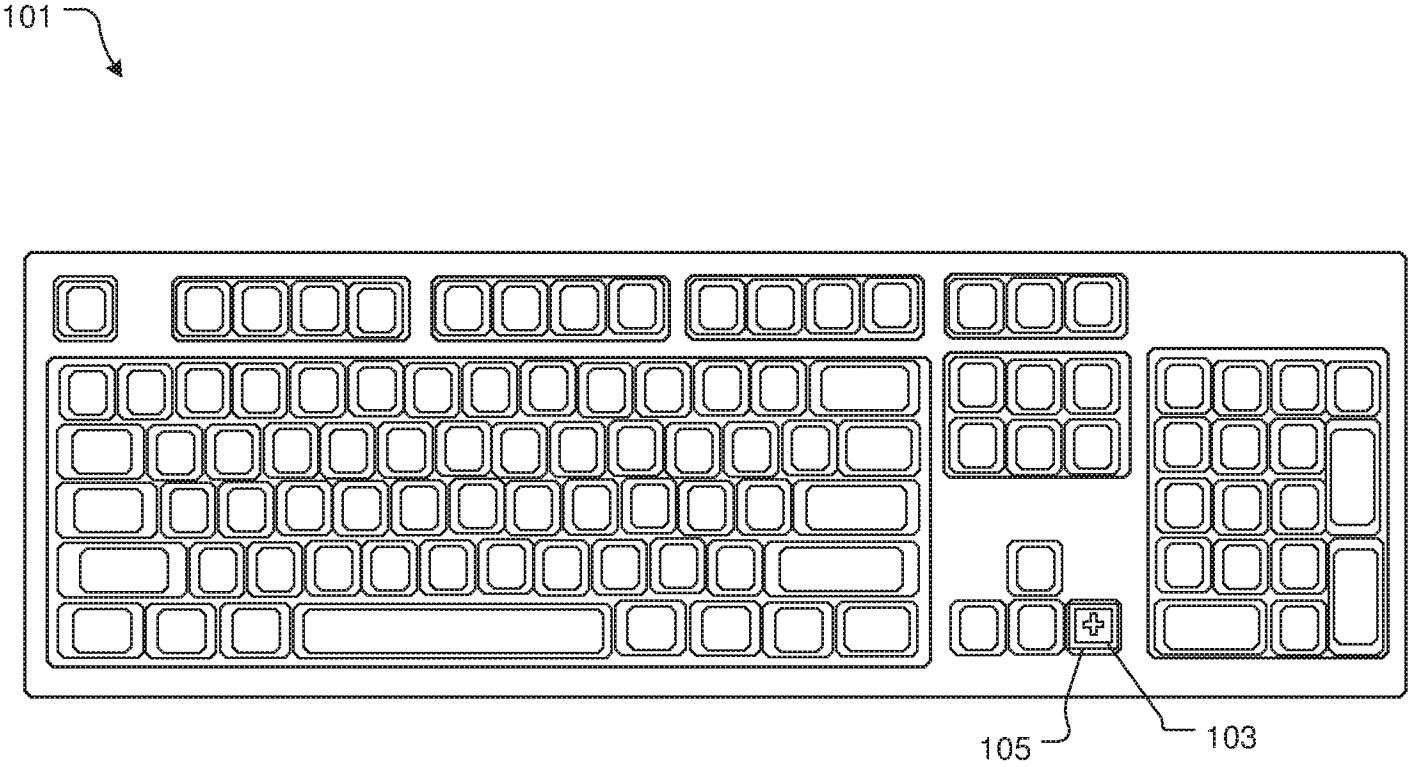
FIG. 1 (Prior Art)
FIG. 1 is a front view if a conventional keyboard.

While the switch and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the switch and method of use of the present application are provided below. It will of course be appreciated that in the development of any actual embodiment, numerous implementation-specific decisions will be made to achieve the developer's specific goals, such as compliance with switch-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The switch and method of use will be understood, both as to its structure and operation, from the accompanying drawings, taken in conjunction with the accompanying description. Several embodiments of the switch are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
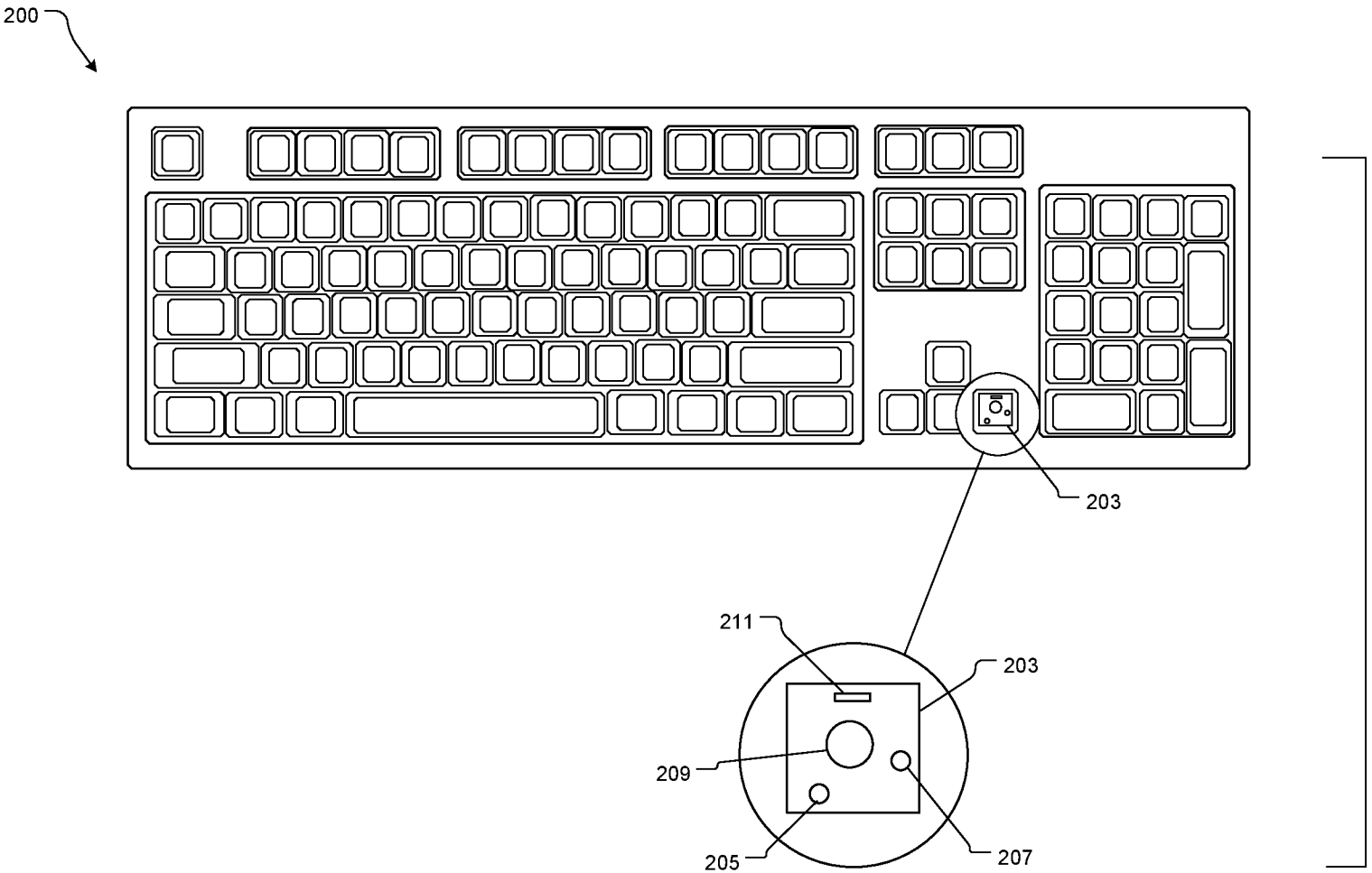
FIG. 2 is a front view of a mechanical keyboard for use with a mechanical switch in accordance with a preferred embodiment of the present application.
Figure 3:
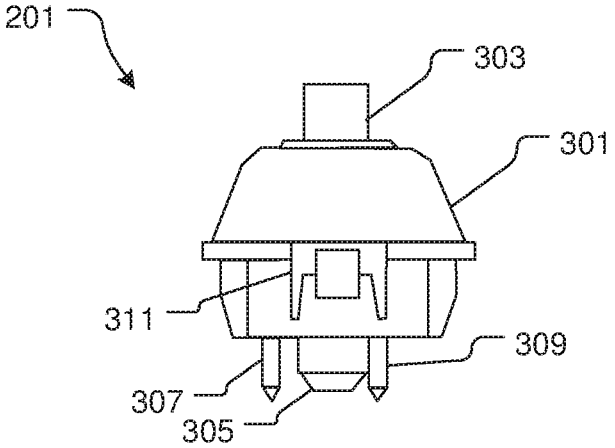
FIG. 3 is a front view of a mechanical switch of FIG. 2.

Referring now to the drawings wherein like reference characters identify corresponding or similar elements throughout the several views, FIG. 2 depicts a top view of a mechanical keyboard 200 for use with a removable switch 201, shown in FIG. 3, in accordance with a preferred embodiment of the present application. It will be appreciated that keyboard 200 overcomes one or more of the above listed problems commonly associated with keyboards.

In the preferred embodiment, switch 201 is operably associated with a PCB 203 having one or more pin holes 205, 207, a central hole 209, and an LED 211. It should be appreciated that PCB 203 is common in the prior art. As shown in FIG. 3, switch 201 includes a housing 301 configured to carry a traversing compressible switch 303 associated with a pillar 305 adapted to fit within hole 209. Switch 201 can further include one or more pins 307, 309 configured to engage with pin holes 205, 207. In one embodiment, switch 201 includes one or more clips 311 configured to snap onto a wall of PCB 203. It should be appreciated that clip 311 provides a means for a user to easily remove and replace switch 201 by hand.

Figure 4:
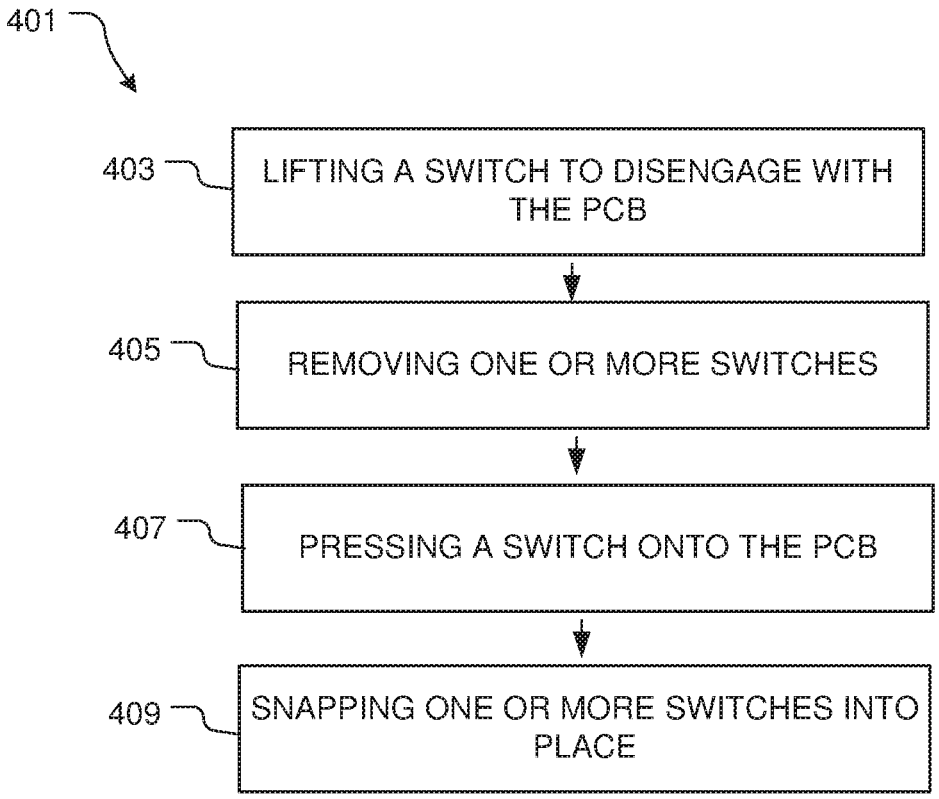
FIG. 4 is a flowchart of the method of FIG. 2.

In FIG. 4, a flowchart 401 depicts the method of use of keyboard 200 and switch 201. During use, the user removes one or more switches from keyboard 200 by lifting up on the switches and disengaging clip 311 from PCB 203, as shown with boxes 403, 405. A new switch is secured to keyboard 200 by pressing the switch onto the PCB and snapping one or more clips to the PCB, as shown with boxes 407, 409. When compressible switch 303 is compressed, pillar 305 turns to engage with PCB 203, thereby allowing a user to use keyboard 200.

The invention sought after is for a mechanical keyboard with removable switches. Mechanical keyboard today have various brands/colors of switches, each that provide its own typing feel/experience. Having mechanical switch further enhances the user experience.

The invention developed allows the switches to be modular, and the user can easily remove and replace any combination of switches like with little to no technical experience.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A mechanical keyboard, comprising:

a plurality of printed circuit boards (PCBs), each having:

a pin holder; and a hole, a plurality of mechanical switches configured to removably engage with the plurality of PCBs, each of the plurality of mechanical switches having:

a body;

a pin extending from the body and configured to engage with the pin holder;

a pillar extending from the body and configured to engage with the hole; and a compressible switch extending upward from the body;

a plurality of keys configured to engage with the compressible switch of each of the plurality of mechanical switches;

wherein each of the plurality of mechanical switches are configured to be removed from the plurality of PCBs by hand.

2. The mechanical keyboard of claim 1, wherein the plurality of mechanical switches further comprises:

a first clip attached to a first side of the body;

wherein each of the first clip is configured to snap onto a first wall of one of the plurality of PCBs.

3. The mechanical keyboard of claim 2, wherein the plurality of mechanical switches further comprises:

a second clip attached to a second side of the body;

wherein each of the second clip is configured to snap onto a second wall of one of the plurality of PCBs.

4. A method of interchanging mechanical switches of a keyboard, the method comprising:

providing the keyboard of claim 3;

removing one or more of the plurality of switches from the plurality of PCBs by hand; and attaching one or more of the plurality of switches to the plurality of PCBs by hand;

wherein the first clips and second clips of the plurality of switches snap onto a first wall and a second wall of the plurality of PCBs.

* * * * *